US006296476B1

(12) United States Patent
Tsai

(10) Patent No.: US 6,296,476 B1
(45) Date of Patent: Oct. 2, 2001

(54) GAS BURNER SAFETY CONTROL MECHANISM

(76) Inventor: Chin-Lin Tsai, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 0 days.

(21) Appl. No.: 09/665,417

(22) Filed: Sep. 20, 2000

(30) Foreign Application Priority Data

Apr. 9, 2000 (TW) ..... 89215325 U

(51) Int. Cl.[7] ..... F23D 11/36
(52) U.S. Cl. ..... 431/153; 431/255; 431/344
(58) Field of Search ..... 431/344, 345, 431/255, 153; 126/406, 407, 408, 409, 413, 414

(56) References Cited

U.S. PATENT DOCUMENTS 5,460,521 * 10/1995 Tsai ..... 431/255
5,647,738 * 7/1997 Tsai ..... 431/255
5,741,128 * 4/1998 Tsai ..... 431/255

* cited by examiner

*Primary Examiner*—Carl D. Price
(74) *Attorney, Agent, or Firm*—Dougherty & Troxell

(57) ABSTRACT

A gas burner safety control mechanism includes a housing, a slide button and a stop device, the stop device being formed of a slide, a control button, a locating rod and a follower plate. The slide is unlocked and moved with the slide button to open the gas valve of a fuel tank when pushing the slide button forwards to trigger a piezoelectric device to ignite fuel gas after the locating rod had been pressed. The slide is locked to hold the gas valve in the open position when pressing the control button.

8 Claims, 6 Drawing Sheets

IV-IV

V-V

GAS BURNER SAFETY CONTROL MECHANISM

BACKGROUND OF THE INVENTION

1. Field of The Invention

The present invention relates to a gas burner and, more specifically, to a safety control mechanism for use in a gas burner, for example, the gas burner shown in U.S. patent application Ser. No. 09/481,383, which can be locked to stop the gas burner from being triggered by an accident.

2. Description of Related Art

A burning device may be used to make fire instead of matches. Further, handy gas burners, for example, hand gas torches are popularly accepted by consumers for the advantages of high mobility and ease of use. However, these handy gas burners must be kept away from reach of children. Because conventional handy gas burners can easily accidentally be triggered to make fire, they are not safe in use. In order to eliminate this problem, most advances countries have defined safety rules, enforcing gas burner manufacturers to provide gas burners with safety means. Similar safety means have been seen in U.S. Pat. No. 5,460,521 (equivalent to Taiwan Utility Model No. 106178) and U.S. Pat. No. 5,741,128 (equivalent to Taiwan Utility Model No. 137470), which were issued to the present inventor. A gas burner with safety means can be locked when not in use, and the safety means must be unlocked before each use of the gas burner. However, according to conventional designs, the safety means must be locked manually after each use. This manual locking procedure is complicated.

SUMMARY OF THE INVENTION

The invention has been accomplished to provide a gas burner safety control mechanism, which eliminates the aforesaid drawbacks.

According to the preferred embodiment of the present invention, the gas burner safety control mechanism comprises a housing formed of a left shell and a right shell, the housing comprising a top chamber disposed at a top side thereof, a keyway-like slot and a retaining slot disposed at two opposite lateral sides thereof; a slide button mounted in the top chamber of the housing, the slide button comprising a bottom chamber adapted to hold a piezoelectric device in the top chamber of the housing, and a bottom rod; and a stop device mounted in the housing, the stop device comprised of a slide longitudinally slidably mounted in the housing, a control button, a locating rod, and a follower plate, the slide comprising a front rod forwardly extended from a front side thereof, a first spring mounted on the front rod and stopped against an inside wall of the housing, a top hole disposed at a top side thereof, a second spring mounted in the top hole, a bottom barrel downwardly extended from a bottom side thereof, a third spring mounted in the bottom barrel, a top protruded block stopped against the bottom rod of the slide button, a notched rear coupling portion disposed at a rear side thereof and coupled to the gas valve of a fuel tank, and a vertical mounting hole through top and bottom sides thereof, the follower plate and the slide being fastened together and disposed at two sides of the keyway-like slot of the housing, the follower plate comprising a stepped through hole, the control button being mounted in the stepped through hole of the follower plate and connected to the second spring of the slide, the locating rod having a top extension connected to the third spring of the slide and a bottom extension inserted into the retaining lot of the housing. The locating rod is disengaged from the retaining slot when pressed down, enabling the slide to be pushed forwards to trigger the piezoelectric device and to pull open the gas valve of the fuel tank and the slide is locked when releasing the slide button and pressing the control button to force the control button into engagement with a part of the keyway-like slot after the piezoelectric device had been triggered and the gas valve of the fuel tank had been opened.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
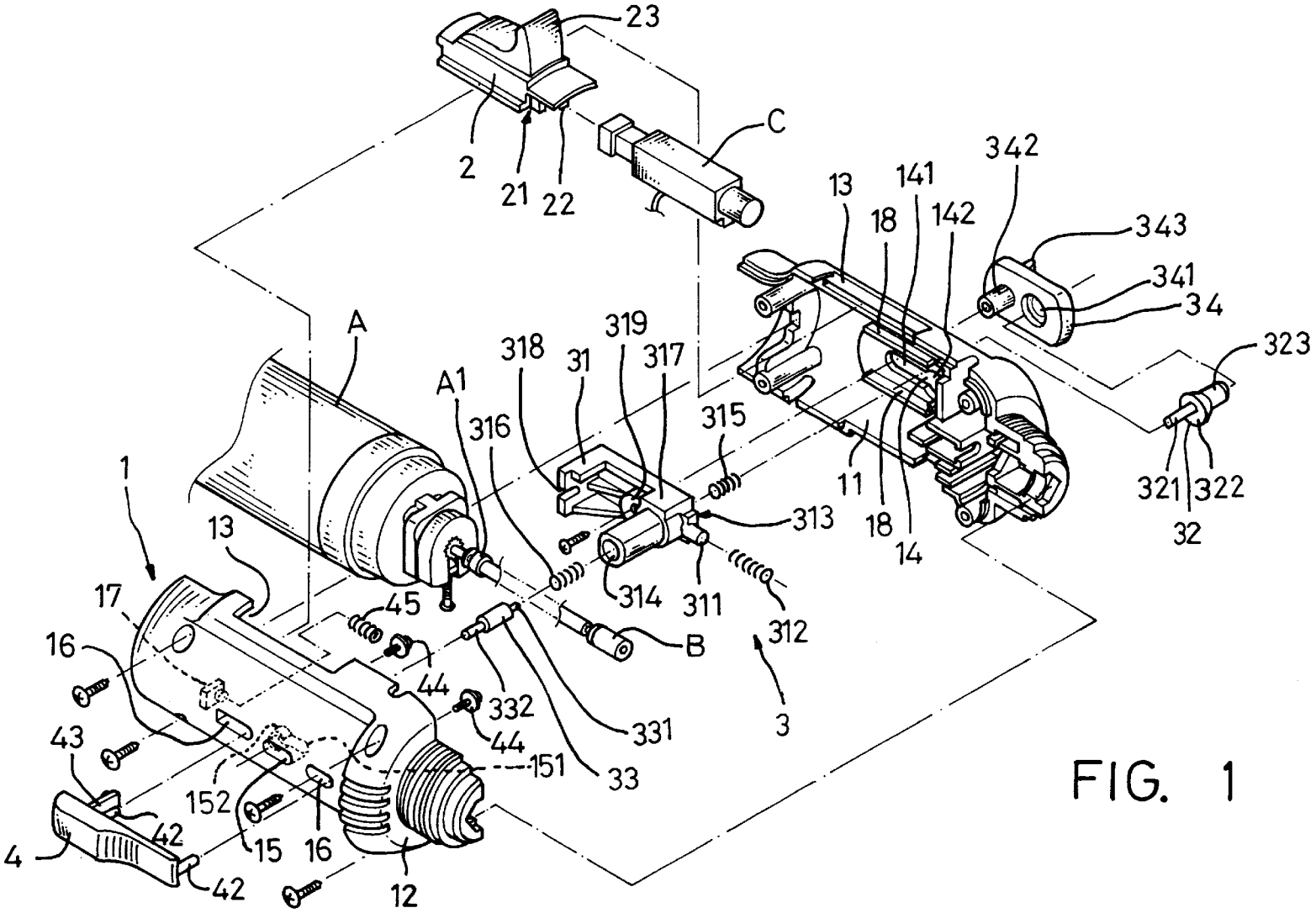
FIG. 1 is an exploded view of an exploded view of a gas burner safety control mechanism according to the present invention.
Figure 2:
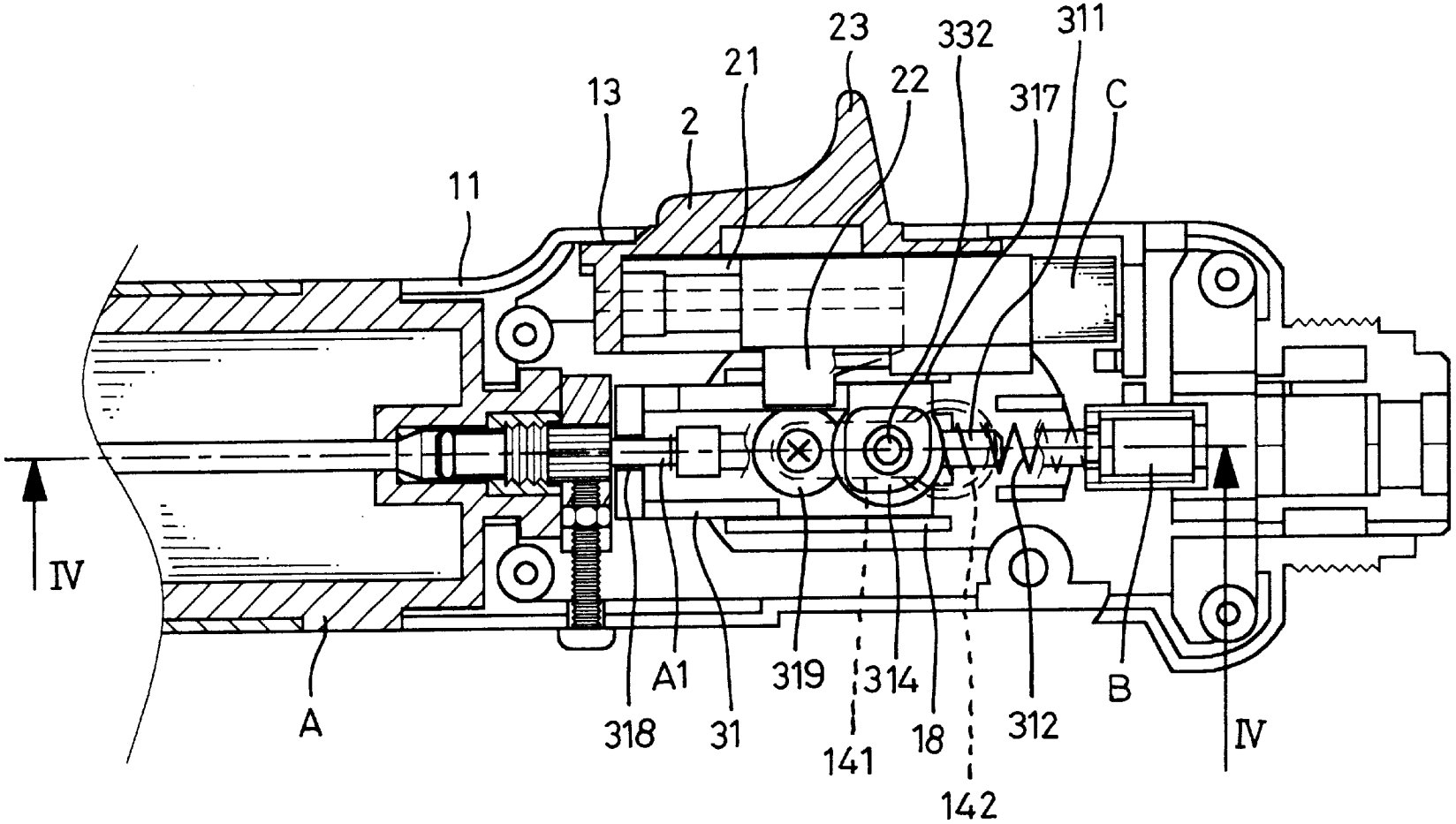
FIG. 2 is a side view in section of the present invention before operation of the safety control mechanism.
Figure 3:
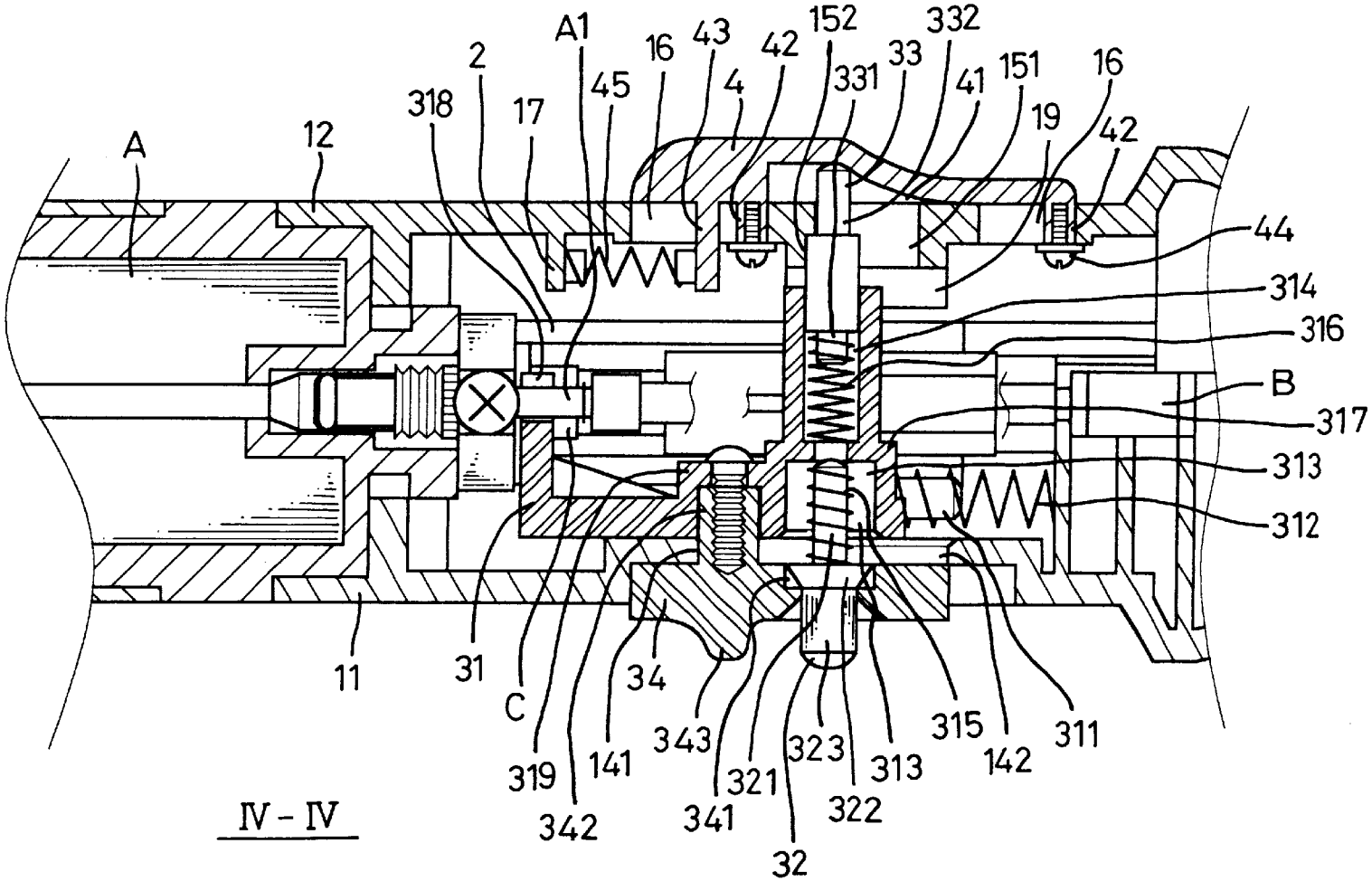
FIG. 3 is a sectional view taken along line IV—IV of FIG. 2.
Figure 4:
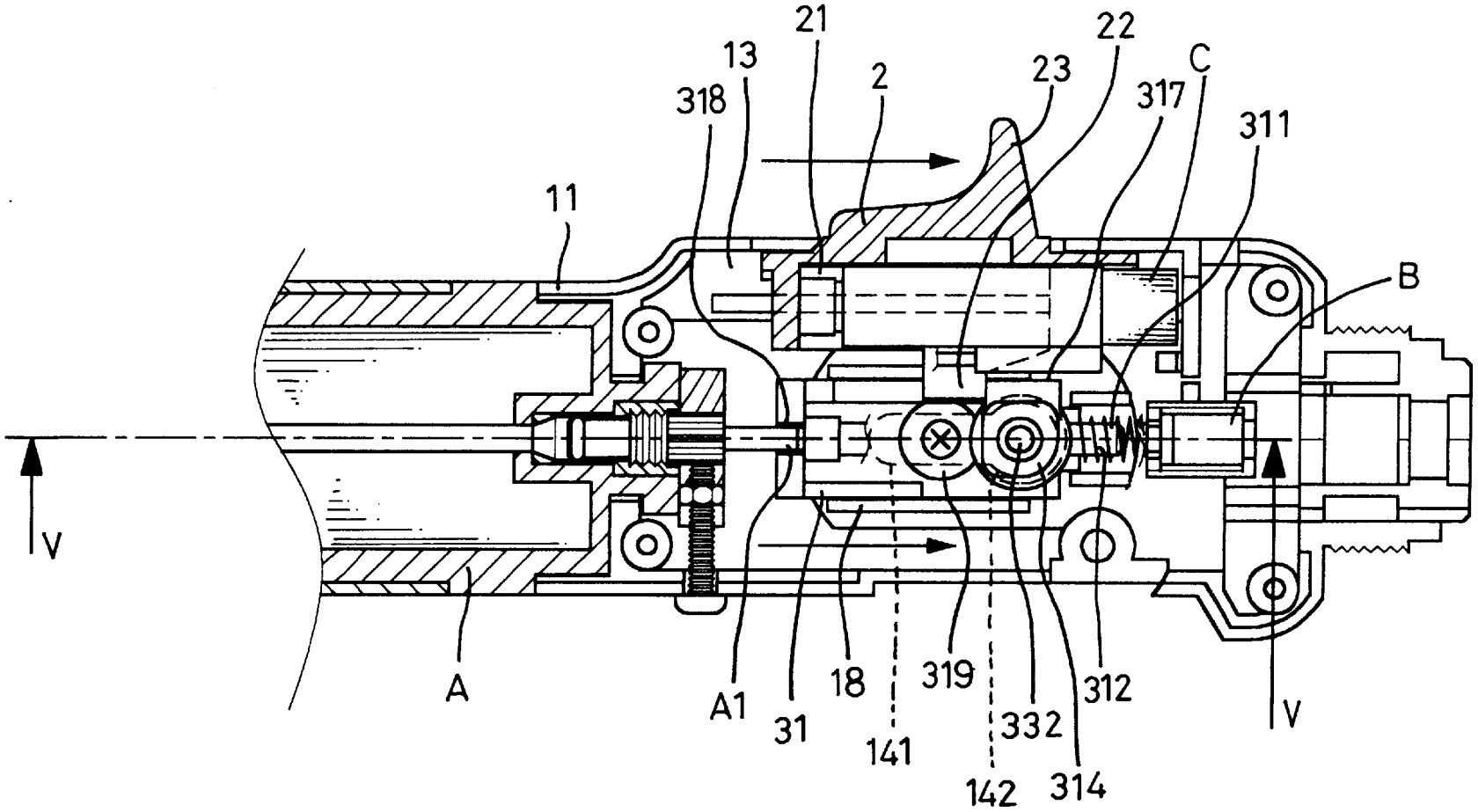
FIG. 4 is a side view in section of the present invention, showing the safety control mechanism operated.
Figure 5:
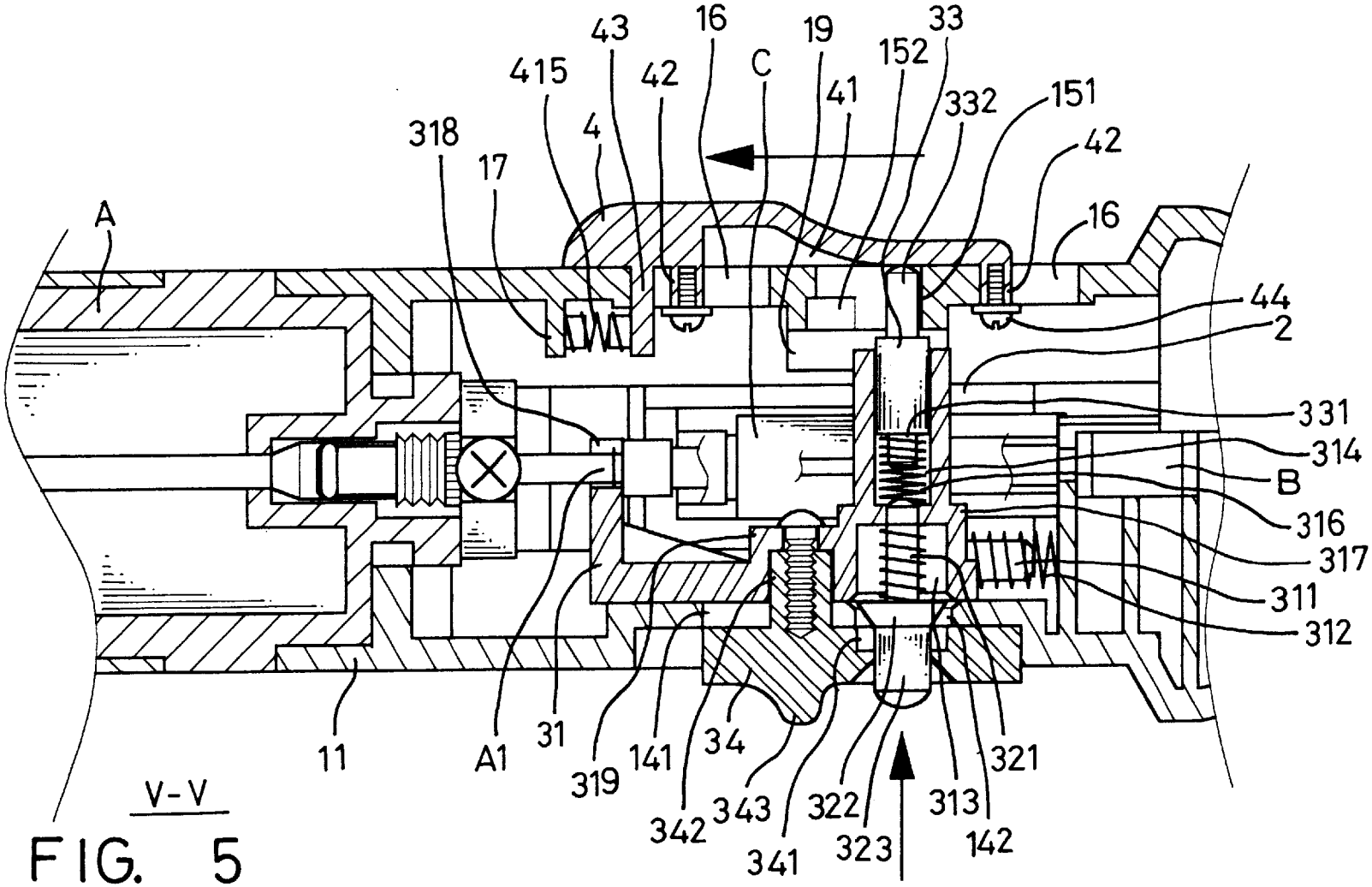
FIG. 5 is a sectional view taken along line V—V of FIG. 4.
Figure 6:
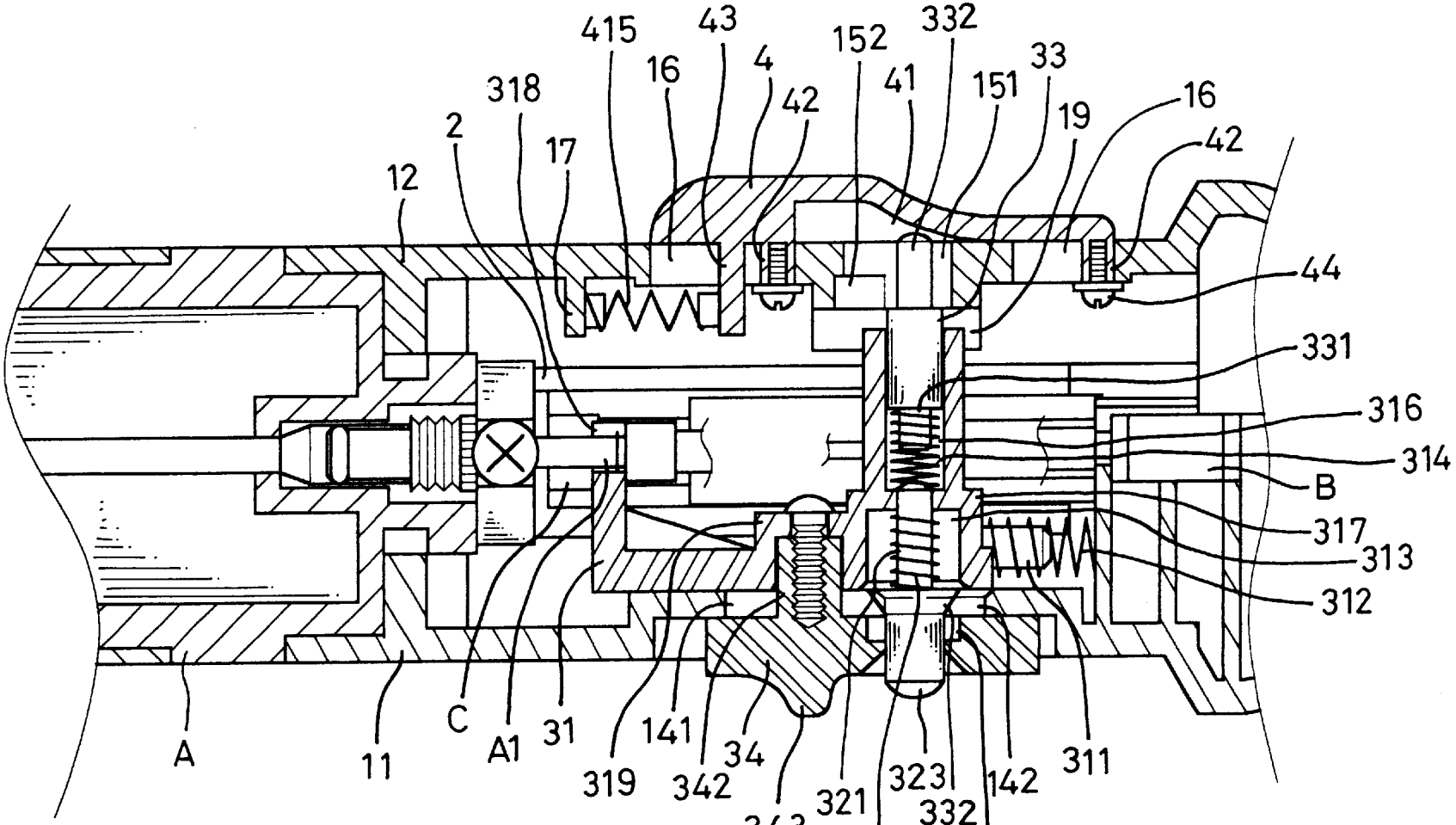
FIG. 6 is similar to FIG. 5 but showing the slide locked in the front position, and the gas valve maintained opened.

Referring to FIGS. 1 through 6, a gas burner safety control mechanism in accordance with the present invention is generally comprised of a housing 1, a slide button 2, and a stop device 3.

The housing 1 is comprised of a left shell 11 and a right shell 12. After the left shell 11 and the right shell 12 had been fastened together, one end of the housing 1 is connected to a fuel tank A, and the other end of the housing 1 receives a gas supply device B and a flame tube assembly (not shown). The housing 1 comprises a top chamber 13 adapted to receive the slide button 2 and a piezoelectric device C, a keyway-like slot 14 and a retaining slot 15 respectively formed in the left shell 11 and the right shell 12 and adapted to receive the stop device 3. The keyway-like slot 14 comprises an elongated narrow section 141, and a short expanded section 142 at one end of the elongated narrow section 141. The retaining slot 15 comprises an engagement hole 151, and a release hole 152 extended from the engagement hole 151.

The slide button 2 is mounted in the top chamber 13 of the housing 1, comprising a bottom chamber 21 adapted to hold the piezoelectric device C in the top chamber 13 of the housing 1, a bottom rod 22 (see FIGS. 2 and 4) adapted to push a slide 31 of the stop device 3 when squeezing the piezoelectric device C, and a top finger strip 23 through which the slide button 2 is pushed with the thumb.

The stop device 3 is comprised of a slide 31, a control button 32, a locating rod 33, and a follower plate 34. The slide 31 is slidably mounted in the housing 1 between the left shell 11 and the right shell 12, comprising a front rod 311 forwardly extended from the front side thereof, a first spring 312 mounted on the front rod 311 and stopped against an inside wall of the housing 1, a top hole 313 disposed at the top side thereof near the front rod 311, a second spring 315 mounted in the top hole 313, a bottom barrel 314 downwardly extended from the bottom side thereof near the front rod 311, a third spring 316 mounted in the bottom barrel 314, a top protruded block 317 stopped against the bottom rod 22 of the slide button 2, a notched rear coupling portion 318 disposed at the rear side thereof and coupled to the gas valve A1 of the fuel tank A, and a vertical mounting hole 319 through the top and bottom sides thereof.

The control button 32 comprises a body 322 adapted to move back and forth on the outside wall of the housing 1 along the elongated narrow section 141 of the keyway-like slot 14, a bottom button rod 321 downwardly extended from the body 322 and inserted through the keyway-like slot 14 of the housing 1 and connected to the second spring 315 of the slide 31, and a finger rod 323 upwardly extended from the body 322 for moving with the fingers.

The locating rod 33 comprises a top extension 331 connected to the third spring 316 of the slide 31, and a bottom extension 332 inserted into the engagement hole 151 of the retaining slot 15. When pressing the bottom extension 332 to compress the third spring 316 of the slide 31, the locating rod 33 is released from the constraint, and can be driven by the slide 31 to move the bottom extension 332 from the engagement hole 151 to the release hole 152, and to unlock the stop device 3. The follower plate 34 is mounted outside the keyway-like slot 14 and coupled to the slide 31, comprising a stepped hole 314 adapted to receive the body 322 and finger rod 323 of the control button 32, a bottom mounting rod 342 inserted through the keyway-like slot 14 and fixedly connected to the mounting hole 319 of the slide 31 by a screw, and a top finger strip 343 for operation.

Further, a sliding key 4 is coupled to the right shell 12 and adapted for pressing the locating rod 33, comprising a beveled groove 41 corresponding to the locating rod 33 (see FIGS. 3 and 5), two bottom guide rods 42 and a bottom stop plate 43 inserted into two sliding slots 16 on the right shell 12 at two sides of the retaining slot 15, and two fastening elements 44 respectively fastened to the bottom guide rods 42 to secure the sliding key 4 to the left shell 12. Further, a spring 45 is connected between the bottom stop plate 43 and a protruded plate 17 inside the right shell 12 to impart a forward pressure to the sliding key 4.

Furthermore, the sliding rails 18 and 19 are respectively provided at the shells 11 and 12, and bilaterally extended along the keyway-like slot 14 and the retaining slot 15 to guide movement of the slide 31.

The operation of the present invention is outlined hereinafter with reference to FIGS. 2 through 6 again. At first, the sliding key 4 is pressed with one hand and pushed backwards toward the fuel tank A to compress the spring 45. During backward movement of the sliding key 4, the beveled groove 41 is moved over the bottom extension 332 of the locating rod 33, thereby causing the locating rod 33 to be moved inwards against the third spring 316 and disengaged from the engagement hole 152 (see FIG. 5) to unlock the stop device 3. After unlocking the stop device 3, the slide button 2 is pushed forwards with the other hand to squeeze the piezoelectric device C and to simultaneously force the bottom rod 22 of the slide button 2 against the top protruded block 317, thereby causing the slide 31 to compress the first spring 312 and to pull open the gas nozzle A1 to supply fuel gas for burning, and at the same time the control button 32, the locating rod 33 and the follower plate 34 are moved forwards with the slide 31 to force the bottom extension 332 of the locating rod 33 to the release hole 152 and the body 322 of the control button 32 to the short expanded section 142. Thereafter, the sliding key 4 is released, enabling the spring 45 to push the sliding key 4 forwards. Then, the control button 32 is pressed, and the slide button 2 is released, enabling the body 322 of the control button 32 to be retained to the short expanded section 142 of the keyway-like slot 14, and therefore the slide 31 is held down in position (see FIG. 6). At this time, fuel gas is discharged from the gas supply device B out of the flame tube assembly, and ignited by the piezoelectric device C. At final, the slide button 2 is released from the hand, and pushed back to its former position by the return force of the piezoelectric device C.

When not in use, the slide button 2 or the follower plate 34 are pushed forwards to force the body 322 of the control button 32 out of the short expanded section 142 of the keyway-like slot 14, enabling the body 322 of the control button 32 to be forced outwards into the stepped hole 341 of the follower plate 34 by the second spring 315, and therefore the slide 31 is released from the constraint and pushed backwards by the first spring 312 to return the gas valve A1 from the open position to the close position. During backward movement of the slide 31, the body 322 of the control button 32 and the bottom extension 332 of the locating rod 33 are respectively backwardly moved along the elongated narrow section 141 of the keyway-like slot 14 and the release hole 152 of the retaining slot 15 to the elongated narrow section 141 the engagement hole 151. After the bottom extension 332 of the locating rod 33 had been moved into the engagement hole 151, the slide 31 is locked, preventing the slide button 2 from movement.

As indicated above, the safety control mechanism must be unlocked before each use of the gas burner, i.e., the locating rod must be disengaged from the housing so that the slide button can be operated to drive the piezoelectric device and to open the gas valve of the fuel tank. After each use, the slide button or the follower plate is pushed again to move the locating rod into engagement with the housing, causing the safety control mechanism to be locked again.

While only one embodiment of the present invention has been shown and described, it will be understood that various modifications and changes could be made thereunto without departing from the spirit and scope of the invention disclosed.

What is claimed is:

1. A gas burner safety control mechanism comprising:

a housing formed of a left shell and a right shell, said housing having a top chamber, a keyway slot and a retaining slot disposed on two opposite lateral sides;

a slide button mounted in the top chamber, said slide button having a bottom chamber holding a piezoelectric device in the top chamber of said housing, and a bottom rod; and a stop device mounted in said housing, said stop device comprised of a slide longitudinally slidably mounted in said housing, a control button, a locating rod, and a follower plate, said slide comprising a front rod forwardly extended from a front side, a first spring mounted on said front rod and stopped against an inside wall of said housing, a top hole disposed at a top side, a second spring mounted in said top hole, a bottom barrel downwardly extended from a bottom side, a third spring mounted in said bottom barrel, a top protruded block stopped against the bottom rod of said slide button, a notched rear coupling portion disposed at a rear side and coupled to a gas valve of a fuel tank, and a vertical mounting hole through top and bottom sides, said follower plate and said slide being fastened together and disposed at sides of said keyway slot of said housing, said follower plate comprising a stepped through hole, said control button being mounted in the stepped through hole and connected to the second spring of said slide, said locating rod having a top extension connected to the third spring of said slide and a bottom extension inserted into the retaining lot of said housing;

wherein said locating rod is disengaged from said retaining slot when pressed down, enabling said slide to be pushed forwards to trigger said piezoelectric device and to pull open the gas valve of said fuel tank, and said slide is locked when releasing said slide button and pressing said control button to force said control button into engagement with a part of said keyway slot after said piezoelectric device has been triggered and the gas valve of said fuel tank has been opened.

2. The gas burner safety control mechanism of claim 1 wherein when pushing said slide bottom or said follower plate to move said slide forwards against the first spring of said slide after engagement of said control button with said keyway slot, the second spring of said slide forces said control button away from constraint of said keyway slot back into the stepped through hole of said follower plate, enabling said slide to be pushed backwards by the first spring of said slide to close the gas valve of said fuel tank and to force said locating rod into engagement with said retaining slot of said housing.

3. The gas burner safety control mechanism of claim 1 wherein said keyway slot of said housing comprises an elongated narrow section, and a short expanded section at an end of said elongated narrow section, and said control button comprises a body adapted to move back and forth on the outside of said housing along said keyway slot, the bottom rod downwardly extended from said body and inserted through said keyway slot of said housing and connected to the second spring of said slide and moved with said body between said elongated narrow section and said short expanded section, and a finger rod upwardly extended from said body and inserted through the stepped through hole of said follower plate.

4. The gas burner safety control mechanism of claim 1 wherein said retaining slot of said housing comprises an engagement hole and a release hole connected to said engagement hole, and said locating rod comprises a top extension connected to the third spring of said slide, and a bottom extension inserted into said retaining slot of said housing and moved with said locating rod between said release hole and said engagement hole.

5. The gas burner safety control mechanism of claim 1 wherein said housing further comprises two sliding rails respectively bilaterally extended along said keyway slot and said retaining slot, and adapted to guide movement of said slide.

6. The gas burner safety control mechanism of claim 1 wherein said slide button and said follower plate each comprise a finger strip.

7. The gas burner safety control mechanism of claim 1 wherein said follower plate comprises a bottom mounting rod inserted through said keyway slot and fixedly connected to said slide.

8. The gas burner safety control mechanism of claim 1 further comprising a sliding key coupled to said housing and adapted for pressing said locating rod, said sliding key comprising a beveled groove corresponding to said locating rod, two bottom guide rods and a bottom stop plate inserted into two sliding slots on said housing at two sides of said retaining slot, two fastening elements respectively fastened to said bottom guide rods to secure said sliding key to said housing, and a spring connected between said bottom stop plate and a protruded plate inside said housing to impart a forward pressure to said sliding key, said beveled groove being moved over said locating rod to force said locating rod away from the constraint of said retaining slot when pushing said sliding key backwards.

* * * * *